US011840890B2

(12) United States Patent
Xie et al.

(10) Patent No.: US 11,840,890 B2
(45) **Date of Patent: *Dec. 12, 2023**

(54) SYSTEM FOR IN-SITU RETAINED CORING OF ROCK SAMPLE

(71) Applicant: SHENZHEN UNIVERSITY, Guangdong (CN)

(72) Inventors: Heping Xie, Guangdong (CN); Mingzhong Gao, Guangdong (CN); Ling Chen, Guangdong (CN); Cunbao Li, Guangdong (CN); Jianbo Zhu, Guangdong (CN); Zhiyi Liao, Guangdong (CN); Cong Li, Guangdong (CN); Jun Guo, Guangdong (CN); Zhiqiang He, Guangdong (CN)

(73) Assignee: SHENZHEN UNIVERSITY, Guangdong (CN)

( * ) Notice: Subject to any disclaimer, the term of this patent is extended or adjusted under 35 U.S.C. 154(b) by 228 days.

This patent is subject to a terminal disclaimer.

(21) Appl. No.: 17/419,071

(22) PCT Filed: Mar. 15, 2019

(86) PCT No.: PCT/CN2019/078303

§ 371 (c)(1),
(2) Date: Feb. 2, 2022

(87) PCT Pub. No.: WO2020/133726

PCT Pub. Date: Jul. 2, 2020

(65) Prior Publication Data

US 2022/0162912 A1 May 26, 2022

(30) Foreign Application Priority Data

Dec. 26, 2018 (CN) ..... 201811596433.2

(51) Int. Cl.
*E21B 10/02* (2006.01)
*E21B 10/60* (2006.01)
(Continued)

(52) U.S. Cl.
CPC ..... *E21B 10/02* (2013.01); *E21B 10/605* (2013.01); *E21B 25/08* (2013.01); *E21B 25/10* (2013.01)

(58) Field of Classification Search
CPC ..... E21B 10/02; E21B 10/605; E21B 25/08; E21B 25/10; E21B 10/26; E21B 10/44; E21B 2200/05; E21B 34/06
See application file for complete search history.

(56) References Cited

U.S. PATENT DOCUMENTS 4,071,099 A * 1/1978 Hensel, Jr. ..... E21B 25/005 73/864.91
4,716,974 A * 1/1988 Radford ..... E21B 25/08 175/59
(Continued)

FOREIGN PATENT DOCUMENTS

CN 101215959 A * 7/2008
CN 106124242 A 11/2016
(Continued)

*Primary Examiner* — Taras P Bemko
(74) *Attorney, Agent, or Firm* — NKL Law; Allen Xue

(57) ABSTRACT

A system for the in-situ retained coring of a rock sample has a driving module (300), a retaining module (200), and a coring module (100) which are connected in sequence. The coring module (100) includes a rock core drilling tool and a rock core sample storage cylinder, the retaining module (200) includes a rock core sample retaining compartment. The driving module includes a coring drill machine that has a drill machine outer cylinder unlocking mechanism. The rock core drilling tool includes a coring drill tool, a core catcher (11), and an inner core pipe (12). The coring drill tool has an outer core pipe (13) and a hollow drill bit (14).
(Continued)

The rock core sample retaining compartment has an inner coring cylinder (28), an outer coring cylinder (26), and an energy accumulator (229).

10 Claims, 18 Drawing Sheets

(51) Int. Cl.
*E21B 25/08* (2006.01)
*E21B 25/10* (2006.01)

(56) References Cited

U.S. PATENT DOCUMENTS

| | | | | |
|---|---|---|---|---|
| 6,283,228 | B2 * | 9/2001 | Collee | E21B 25/08 175/58 |
| 8,307,704 | B2 * | 11/2012 | Georgi | G01V 9/00 73/152.07 |
| 9,828,820 | B2 * | 11/2017 | Gupta | G01V 5/04 |

FOREIGN PATENT DOCUMENTS

| | | | | |
|---|---|---|---|---|
| CN | 205785892 | U | | 12/2016 |
| CN | 106932223 | A | * | 7/2017 |
| CN | 107558939 | A | | 1/2018 |
| RU | 2200225 | C2 | | 3/2003 |
| RU | 2209912 | C1 | | 8/2003 |

* cited by examiner

SYSTEM FOR IN-SITU RETAINED CORING OF ROCK SAMPLE

TECHNICAL FIELD

The present invention relates to the field of oil and gas field exploration, and in particular to an in-situ condition-retaining coring system of a rock sample.

BACKGROUND ART

In the process of oilfield exploration, rock core is the key material for discovering oil and gas reservoir, as well as studying stratum, source rock, reservoir rock, cap rock, structure, and so on. Through the observation and study of the core, the lithology, physical properties, as well as the occurrence and characteristics of oil, gas, and water can be directly understood. After the oilfield is put into development, it is necessary to further study and understand the reservoir sedimentary characteristics, reservoir physical properties, pore structure, wettability, relative permeability, lithofacies characteristics, reservoir physical simulation, and reservoir water flooding law through core. Understanding and mastering the water flooded characteristics of reservoirs in different development stages and water cut stages, and finding out the distribution of remaining oil can provide scientific basis for the design of oilfield development plan, formation system, well pattern adjustment, and infill well.

Coring is to use special coring tools to take underground rocks to the ground in the process of drilling, and this kind of rock is called core. Through it, various properties of rocks can be determined, underground structure and sedimentary environment can be studied intuitively, and fluid properties can be understood, etc. In the process of mineral exploration and development, the drilling work can be carried out according to the geological design of strata and depth, and coring tools were put into the well, to drill out core samples and store in the core storage chamber. In the process of equipment rise, the temperature, pressure and other environmental parameters of core storage chamber will be reduced, so that the core can not maintain its state of in-situ conditions.

The coring tool comprises a coring drilling tool and a core catcher. After the coring drilling tool is cut into the stratum, a core catcher makes the core keep in the inner barrel. The core catcher in the prior art can only take soft rock, by which it is difficult to take hard rock. In addition, the coring drilling tool has a slow blade-cooling speed, fast tool wear, and a short service life. Before coring, the coring equipment should be put into the drilling hole as a whole. After it reaches the working site, the rear part of the coring equipment should be fixed, whose front working mechanism should be relieved of the constraint and continue to work forward.

Content of the Invention

The present invention aims to provide an in-situ condition-retaining coring system of a rock sample, which is beneficial for maintaining the in situ conditions of the core, and can improve the drilling speed and the coring efficiency. The outer barrel can be locked before the coring drill machine works, and when the coring drill machine starts to work, the restraint on the outer barrel is released. To achieve the above objective, the present invention is realized by the following technical solutions: The in-situ condition-retaining coring system of a rock sample disclosed in the present invention comprises a driving module, a retaining module, and a coring module which are connected in sequence, wherein the coring module comprises a rock core drilling tool and a rock core sample storage cylinder; the retaining module comprises a rock core sample retaining compartment; the driving module comprises a coring drill machine that comprises a drill machine outer cylinder unlocking mechanism; the rock core drilling tool comprises a coring drill tool, a core catcher, and an inner core pipe; the coring drill tool comprises an outer core pipe and a hollow drill bit, and the drill bit is connected to the lower end of the outer core pipe; the core catcher comprises an annular base and a plurality of j aws, the annular base is coaxially mounted on the inner wall of the lower end of the inner core pipe, and the jaws are uniformly arranged on the annular base. The lower end of the jaws is connected with the annular base, and the upper end of the jaws is closed inward; the lower end of the inner core pipe extends to the bottom of the outer core pipe, and the inner core pipe is in clearance fit with the outer core pipe;

said core sample storage barrel comprises a rock core barrel, a drilling machine outer cylinder, a flap valve and a trigger mechanism. The flap valve comprises a valve seat and a sealing flap, the valve seat is coaxially mounted on the inner wall of the drilling machine outer cylinder, and one end of the sealing flap is movably connected to the outer sidewall of the upper end of the valve seat; the top of the valve seat is provided with a valve port sealing surface matched with the sealing flap. The rock core sample fidelity-retaining cabin comprises an inner coring barrel, an outer coring barrel, and an energy accumulator. The outer coring barrel is sleeved on the inner coring barrel; the upper end of the inner coring barrel is communicated with a liquid nitrogen storage tank, and the liquid nitrogen storage tank is located in the outer coring barrel; the energy accumulator is communicated with the outer coring barrel; the outer coring barrel is provided with a flap valve;

said outer cylinder unlocking mechanism comprises a connecting pipe, an outer barrel and a locking pin. The connecting pipe, the outer barrel and the locking pin are coaxial, the locking pin is in the connecting pipe, and the outer diameter of the front section of the connecting pipe is shorter than the inner diameter of the outer barrel. There is a through hole A on the side wall of the front section of the connecting pipe. There is a groove A on the outer wall of the locking pin, while there is a groove B on the inner wall of the outer barrel. The pin is also comprised, and the length of the pin is greater than the depth of the through hole A. The pin is arranged in the through hole A, and the outer end of the pin is chamfered and/or the side surface of the groove B is inclined. The width of groove A is not less than the width of the inner end of the pin, while the width of the groove B is not less than the width of the outer end of the pin. Before starting, the front end of the connecting pipe is in the outer barrel, and the pin is in front of the groove A. The inner end surface of the pin is in sliding fit with the outer wall of the locking pin, and the outer end of the pin is embedded in the groove B. After starting, the inner end of the pin is embedded in the groove A. The distance from the inner end surface of the pin to the inner wall of the outer barrel is greater than the length of the pin.

Further, the rock core sample retaining compartment further comprises an electric heater, a temperature sensor, an electric control valve arranged between the inner coring barrel and the liquid nitrogen storage tank, a pressure sensor, and a three-way stop valve A arranged between the energy accumulator and the outer coring barrel. The two ways of the three-way stop valve A are respectively connected with the energy accumulator and the outer coring barrel, while the third way of the three-way stop valve A is connected with a pressure relief valve, and the stop valve A is an electrically controlled valve. The temperature sensor and the pressure sensor are connected to the processing unit, and the electric heater, the electric control valve and the three-way stop valve A are all controlled by the processing unit. The electric heater is used to heat the inside of the outer coring barrel, the temperature sensor is used to detect the temperature in the fidelity-retaining compartment, and the pressure sensor is used to detect the pressure in the fidelity-retaining compartment.

Preferably, the drill bit includes a first-stage blade for drilling and a second-stage blade for reaming. The drill bit comprises an inner drill bit and an outer drill bit. The inner drill bit is installed in the outer drill bit, and the first-stage blade is located at the lower end of the inner drill bit, while the secondary blade is located on the outer sidewall of the outer drill bit. The first-stage blades are provided with three at equal intervals in the circumferential direction, and the second-stage blades are also provided with three at equal intervals in the circumferential direction, and both the first-stage blades and the second-stage blades on the drill bit are provided with coolant circuit holes.

Preferably, the outer core pipe and the outer wall of the drill bit are both provided with a spiral groove, and the spiral groove on the drill bit is continuous with that on the outer core tube.

Preferably, the claw comprises a vertical arm and a tilt arm which are integrally manufactured. The lower end of the vertical arm is connected with the annular base, while the upper end of the vertical arm is connected with the lower end of the tilt arm. The upper end of the tilt arm is a free end, and the tilt arm tilts inward from bottom to top, with a tilt angle of 60°.

Preferably, the sealing valve flap includes an elastic sealing ring, elastic connecting strips, sealings, and a plurality of locking strips arranged in parallel; the elastic connecting strip connects all the locking strips in series, and the elastic sealing ring loops all the locking strips together, to form an integral structure. The locking strip is provided with a groove adapted to the elastic sealing ring, and the elastic sealing ring is installed in the groove. There is a sealing between two adjacent locking strips. One end of the valve flap is movably connected to the upper end of the valve seat through a limit hinge; the valve flap is curved when it is not turned down, and the valve flap is attached to the outer wall of the inner coring barrel; the valve flap is flat when it is turned down and covers the upper end of the valve seat.

Further, the inner wall of the outer coring barrel is provided with a sealing cavity, and the flap plate is located in the sealing cavity. The sealing cavity is in communication with the inner coring barrel. The inner wall of the outer coring barrel is provided with a sealing ring, which is located below the flap valve.

Preferably, the electric heater is a resistance wire, which is embedded in the inner wall of the outer coring barrel, and coated with an insulating layer; a graphene layer is covered on the inner wall of the inner coring barrel; the upper part of the inner coring barrel is filled with a drip film-forming agent. Preferably, an interlocking mechanism is connected behind the connecting pipe, and a starting mechanism is connected behind the locking pin. A side surface of the groove A is an inclined plane. A drill bit and a hydraulic motor rotor are connected in front of the outer barrel. A locking piece A is connected behind the locking pin, and a locking piece B is connected behind the connecting pipe. The outer diameter of the locking piece A is greater than the inner diameter of the locking piece B, and the locking piece A is behind the locking piece B. The angle between the outer chamfer of the pin and the radial section is complementary to the angle between the side of groove B and the radial section. The pin includes a nail head and a nail body, and a through hole A is correspondingly provided with a nail head section and a nail body section.

Preferably, the length of the pin head is less than the depth of the pin head section, but the length of the pin body is greater than the depth of the pin body section. The through hole A is circular, and there are three through holes A. The axial distance from the center of each through hole A to the front end of the connecting tube is the same, and three through holes A are evenly distributed along the circumference.

The present invention has the following beneficial effects:

1. In the present invention, the fidelity-retaining cabin can be automatically heated and cooled, which is beneficial for the core to maintain its in situ conditions.
2. In the present invention, the fidelity-retaining cabin can be automatically pressured, which is beneficial for the core to maintain its in situ conditions.
3. The flap mechanism of the present invention can automatically close the fidelity-retaining cabin when the coring is completed, and has a simple structure, safety and reliability.
4. The graphene layer of the present invention can reduce the sliding resistance of the core on the inner side of the PVC pipe, improve the strength and surface accuracy of the inner side, and enhance the thermal conductivity coefficient and the like.
5. The sealing cavity of the present invention can isolate the drilling fluid passing through the fidelity-retaining cavity.
6. In the present invention, a mechanical claw that faces upwards and is folded inward is designed. When the claws go down, the claws are easily propped up by the core, so that the core enters the inner core barrel; when the claws go up, it is difficult for claws to be stretched by the rock core, and because the rock core cannot resist the greater pulling force and the clamping action of the claws, the rock core is broken at the claws, and the broken core will continue to move up with the claws and remain in the inner barrel.
7. In the present invention, the drill bit is divided into two-stage blades, the bottom blade drills a small hole first, and then the upper blade expands the hole, so as to improve the drilling speed and the coring efficiency.
8. In the present invention, a through hole is provided in the blade part as a coolant circuit hole, and the coolant can be sprayed out through the through hole to cool the blade, speed up the cooling rate of the blade, reduce the wear of the tool, and extend the life of the blade.
9. The outer wall of the outer core tube is provided with a spiral groove continuous with that of the drill bit, and as the outer core tube is screwed into the rock formation, the outer core tube creates a closed space for the coring tool, which can prevent the fidelity-retaining cabin from being contaminated.

10. The outer barrel can be locked before the coring drill machine works, and when the coring drill machine starts to work, the restraint on the outer barrel is released.

Examples

Figure 1:
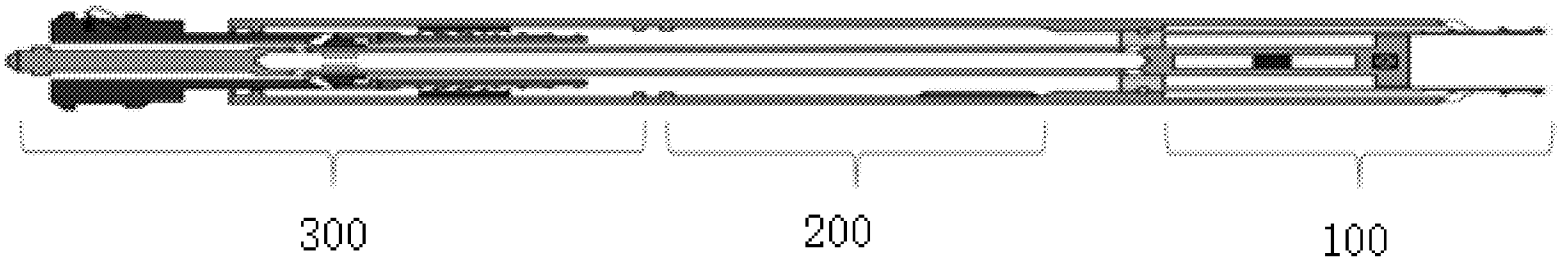
FIG. 1. The structural schematic diagram of the present invention.

In order to make the objectives, technical solutions, and advantages of the present invention clearer, the present invention will be further illustrated hereinafter by combing with the attached Figures. As shown in FIG. 1, the in-situ condition-retaining coring system of a rock sample disclosed in the present invention comprises a driving module 300, a retaining modulev200, and a coring module 100 which are connected in sequence, wherein the coring module comprises a rock core drilling tool and a rock core sample storage cylinder; the retaining module comprises a rock core sample retaining compartment; the driving module comprises a coring drill machine that comprises a drill machine outer cylinder unlocking mechanism.

Figure 2:
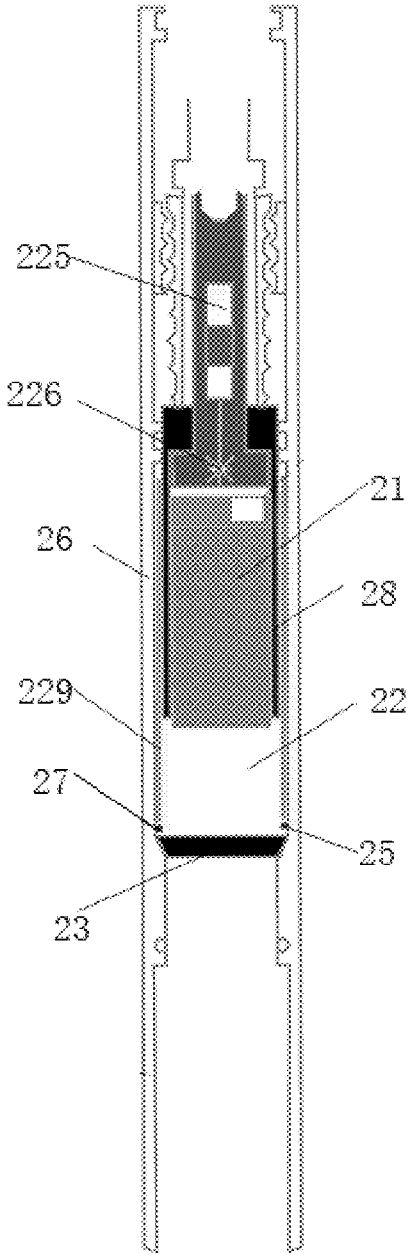
FIG. 2. The structural schematic diagram of the rock core sample retaining compartment.

As shown in FIG. 2, the rock core sample retaining compartment comprises a mechanical part and a control part. The mechanical part includes an inner coring barrel 28, an outer coring barrel 26 and an energy accumulator 229. The energy accumulator 229 is connected to the outer coring barrel, and the inner coring barrel 28 is used to place the rock core 21, and the outer coring barrel 26 is sleeved on the inner coring barrel 28. The upper end of the inner coring barrel 28 is connected to the liquid nitrogen storage tank 225. An electric control valve 226 is arranged on the communication pipeline between the inner coring barrel 28 and the liquid nitrogen storage tank 225. The liquid nitrogen storage tank 225 is located in the outer coring barrel 26, and the outer coring barrel 26 is provided with a flap valve 23.

Figure 3:
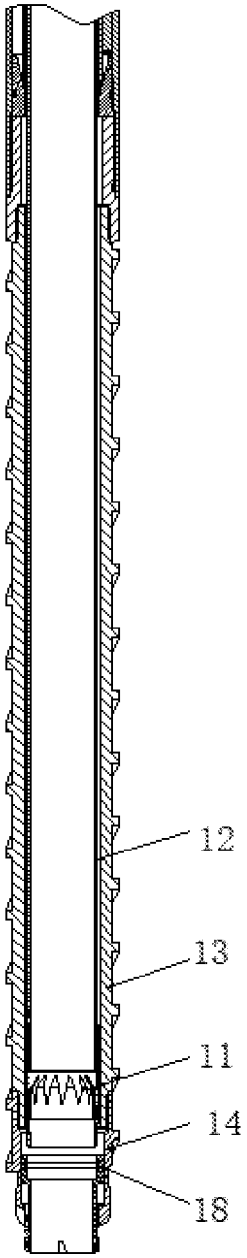
FIG. 3. The structural schematic diagram of the rock core drilling tool.
Figure 8:
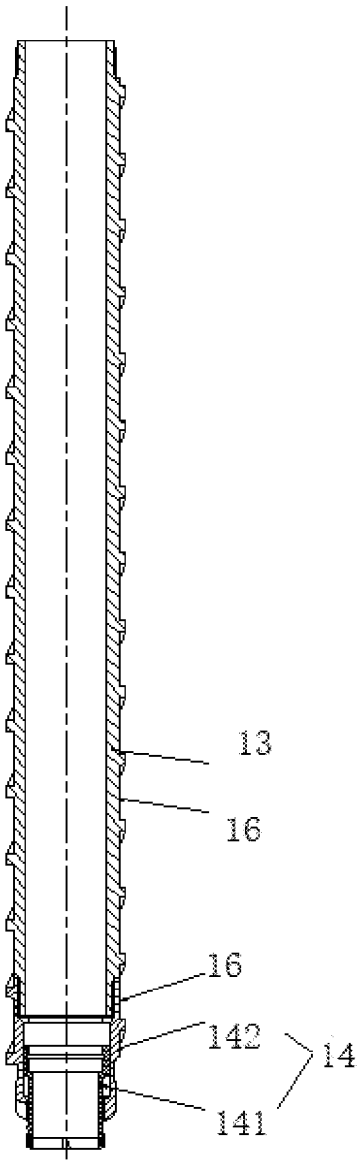
FIG. 8. The structural schematic diagram of the coring drilling tool.

As shown in FIGS. 3 and 8, the rock core drilling tool comprises a coring drilling tool, a core catcher 11, and an inner core pipe 12. The coring drilling tool comprises an outer core pipe 13 and a hollow drill bit 14, and the drill bit 14 is connected to the lower end of the outer core pipe 13. The core catcher 11 is mounted on the inner wall of the lower end of the inner core pipe 12. The lower end of the inner core pipe 12 extends to the bottom of the outer core pipe 13 and is in clearance fit with the outer core pipe 13.

Figure 6:
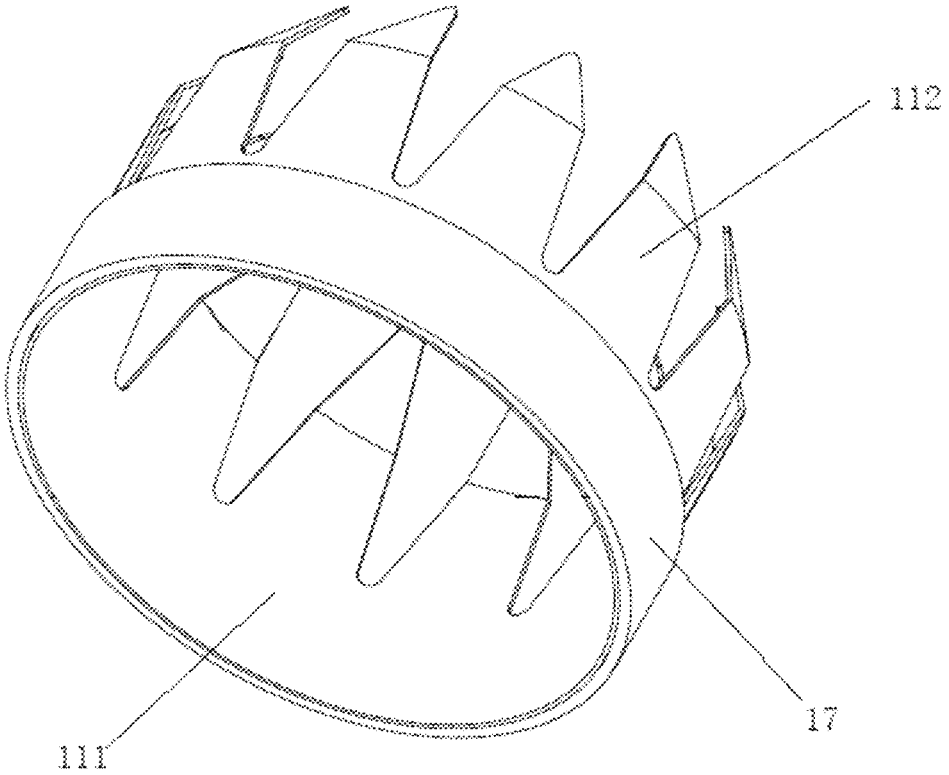
FIG. 6. 3D drawing of the core catcher.
Figure 7:
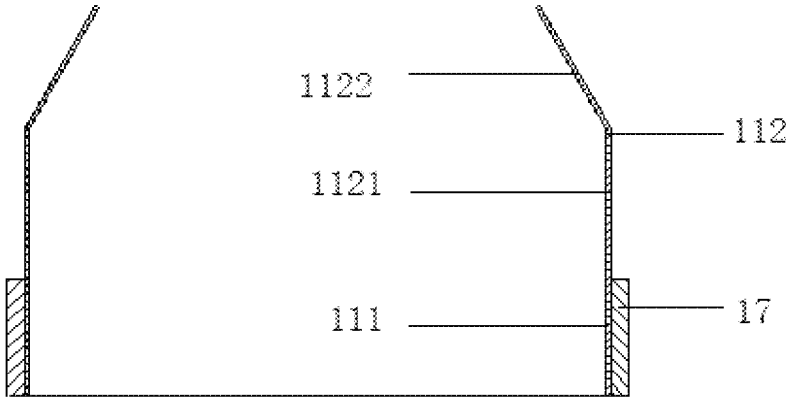
FIG. 7. Sectional view of the core catcher.

As shown in FIGS. 6 and 7, the core catcher 11 includes an annular base 111 and a plurality of claws 112. The claws 112 are evenly arranged on the annular base 111. The lower ends of the claws 112 are connected with the annular base 111, while the upper ends of the claws 112 are folded inward. There are 8~15 claws 112, preferably 12 claws 112. The number of claws 112 can be set as required, and is not limited to those listed above.

The claw 112 includes integrally manufactured vertical arm 1121 and tilt arm 1122. The lower end of the vertical arm 1121 is connected with the annular base 11, while the upper end of the vertical arm 1121 is connected with the lower end of the tilt arm 1122, and the upper end of the tilt arm 1122 is a free end. The tilt arm 1122 is inclined inward from bottom to top, and the inclination of the tilt arm 1122 can be adjusted as required. In this example, the tilt angle of the tilt arm 1122 is 60°, and the width of the claw 112 gradually decreases from bottom to top.

Figure 4:
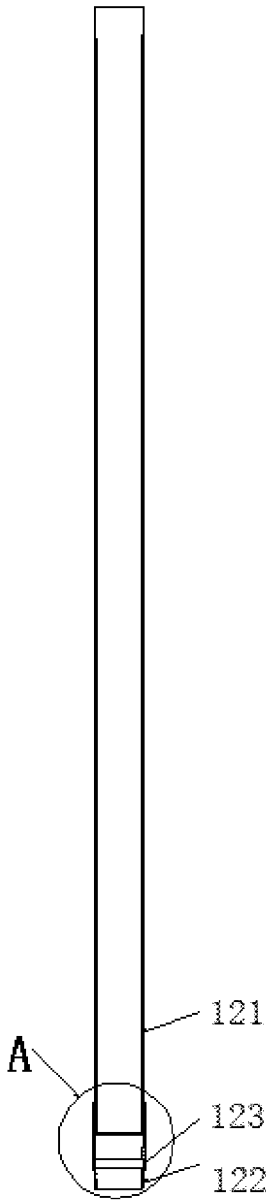
FIG. 4. The structural schematic diagram of the inner core pipe.
Figure 5:
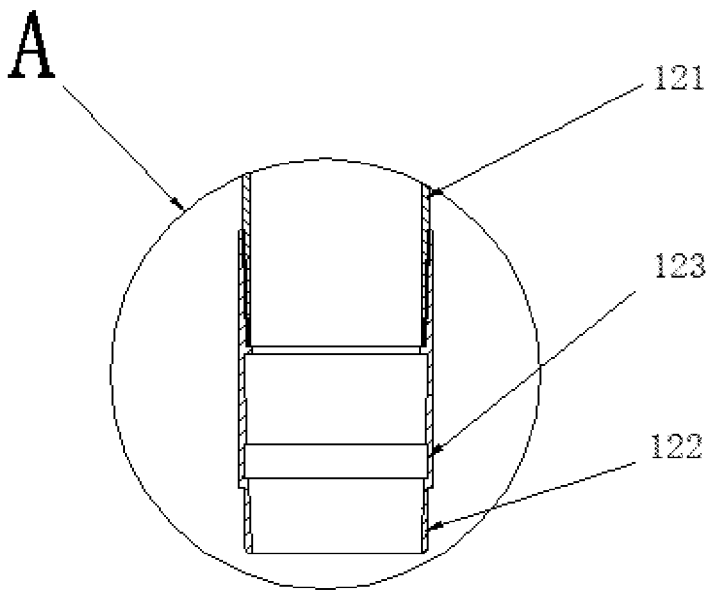
FIG. 5. An enlarged view of A in FIG. 3.

Wherein, the thickness of the pawl 112 is equal to the thickness of the annular base 111, and the pawl 112 is manufactured integrally with the annular base 111. The annular base 111 is sheathed with an annular sleeve 17, and both of annular base 111 and annular sleeve 17 are fixedly connected. The inner wall of the inner core pipe 12 is coated with graphene. As shown in FIGS. 4 and 5, the inner core pipe 12 comprises a core barrel 121 and a core casing 122. The upper end of the core casing 122 is fixed at the lower end of the core barrel 121. The inner wall of the core casing 122 is provided with an annular groove 123 adapted to the annular sleeve 17. The annular sleeve 17 is installed in the annular groove 123, and the free end of the jaws 112 faces upward. The free end of the jaws 112 faces upwards and inwards, and when the core passes through the hard core catcher 11 from bottom to top, the jaws 112 are easily stretched, while it is difficult from top to bottom.

Figure 9:
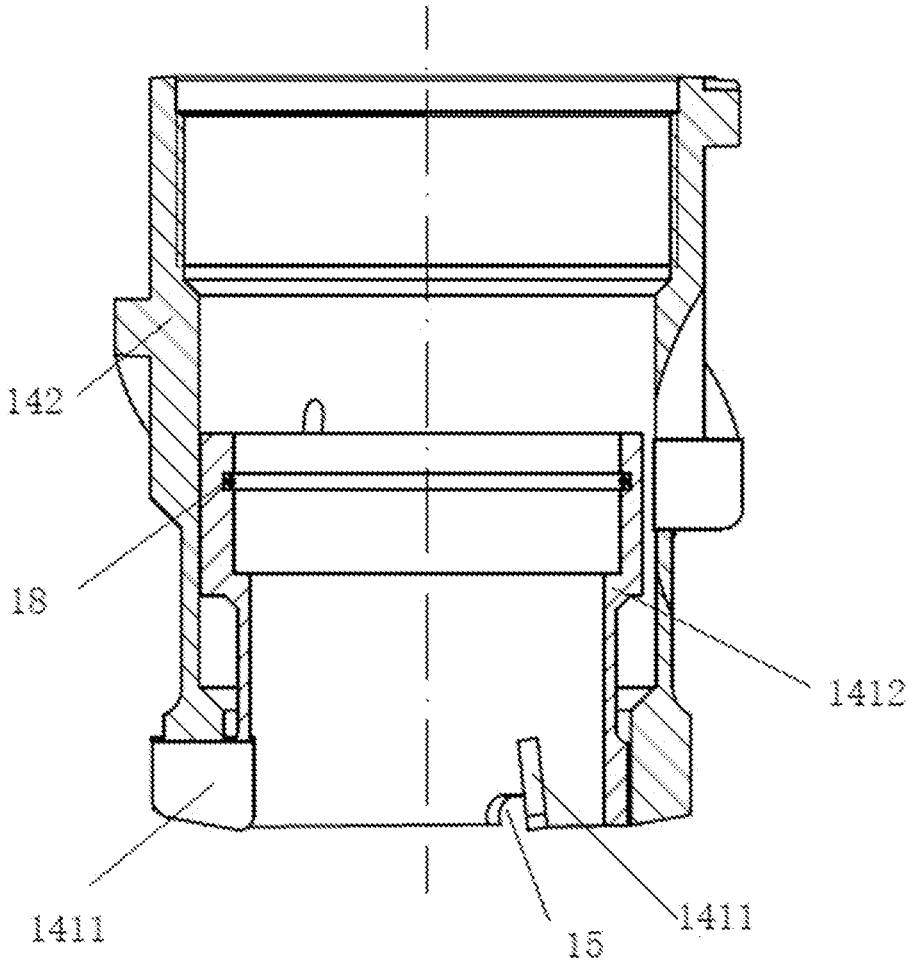
FIG. 9. The structural schematic diagram of the drill bit.
Figure 10:
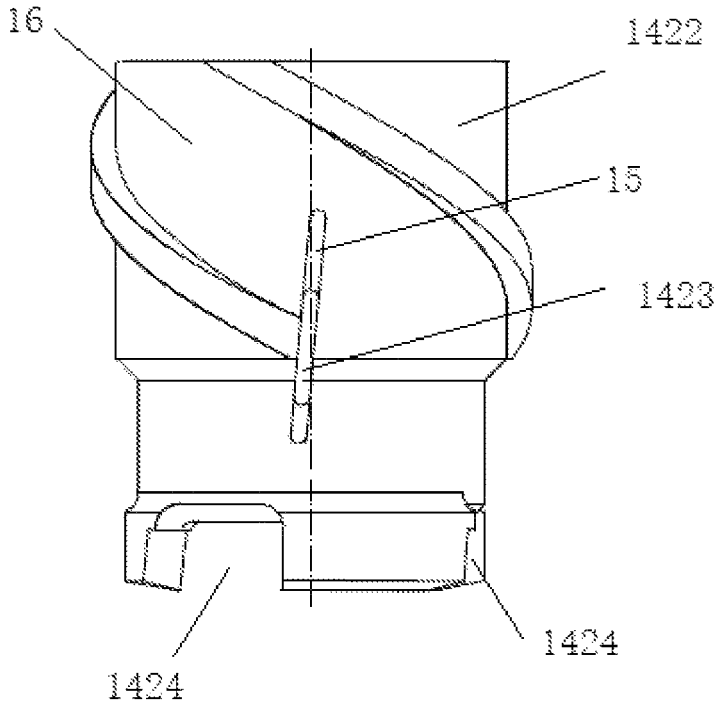
FIG. 10. The structural schematic diagram of the outer drilling cutter body.
Figure 11:
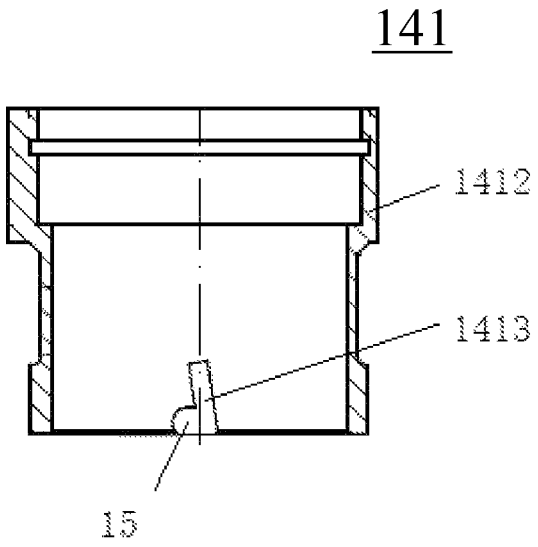
FIG. 11. The structural schematic diagram of the inner drilling cutter body.

The drill bit 14 is a PCD tool. As shown in FIGS. 8 and 9, the drill bit 14 comprises an inner drill bit 141 and an outer drill bit 142, and the inner drill bit 141 includes a first-stage blade 1411 and a hollow inner drill body 1412. As shown in FIG. 10, the lower end of the inner drill body 1412 is provided with a first-stage blade installation groove 1413 for installing the first-stage blade 1411. The first-stage blade installation groove 1413 is opened on the lower end surface of the inner drill body 1412, on which the first stage blade installation groove 1413 is provided with a coolant circuit hole 15, that is an arc-shaped hole. The arc-shaped hole opens on the front end surface of the drill bit 4 and communicates with the first-stage blade installation groove 1413. The inner drill body 1412 is provided with three first-stage blade mounting grooves 1413 at equal intervals in the circumferential direction. Each first-stage blade mounting groove 1413 is provided with a coolant circuit hole 15, and a first-stage blade 1411 is installed in each first-stage blade mounting groove 1413.

The outer drill bit 142 comprises a second-stage blade 1421 and a hollow outer drill body 1422. As shown in FIG. 10, the outer wall of the second-stage blade 1421 is provided with a second-stage blade installation groove 1423 for installing the second-stage blade 1421, and the second-stage blade installation groove 1423 on the outer drill body 1422 is provided with a coolant circuit hole 15, which is a bar-shaped hole. The bar-shaped hole communicates with the second-stage blade installation groove 1423. The outer drill body 1422 is provided with three second-stage blade installation grooves 1423 at equal intervals in the circumferential direction, and each second-stage blade installation groove 1423 is provided with a coolant circuit hole 15, and each second-stage blade 1421 is installed in each second-stage blade installation groove 1423.

The inner drill 141 is installed inside the outer drill 142, and the outer drill body 1422 has a first-stage blade avoidance notch 1424 at a position corresponding to the first-stage blade 1411. The first-stage blade avoidance notch 1424 opens on the front end of the outer drill 142. The cutting edge of the first-stage blade 1411 is exposed from the outer drill body 1422 by the first-stage blade avoidance notch 1424.

The inner wall of the inner drill body 1412 is provided with a seal ring 18, and the seal ring 18 is located above the first-stage blade 1411. Using a highly elastic annular sealing ring, the rock core can be wrapped in the process of coring, so as to achieve the effect of isolation and quality assurance, as well as realize the objectives of moisturizing and guaranteeing the quality.

In the present invention, the drill bit is divided into two-stage blades. The first-stage blade 1411 at the lower end first drills a small hole, and then the second-stage blade 1421 at the upper reams the hole, which can increase the drilling speed. A through hole is provided at the blade position as a cooling liquid circuit hole 15, through which cooling liquid can be sprayed to cool the blade. The carbide sharp thin bit is used to cut the rock stratum, to reduce the disturbance of coring process to the formation and ensure the integrity and quality of coring.

As shown in FIGS. 3, 8, and 10, both the outer core tube 13 and the outer wall of the outer drill body 1422 are provided with spiral grooves 6, and the spiral groove 16 on the outer drill body 1422 is continuous with the spiral groove 16 on the outer core tube 13. The outer core tube 16 with the spiral groove 13 on the outer wall is equivalent to a spiral outer drill. As the outer core tube 13 is screwed into the rock formation, the outer core tube 13 creates a closed space for the coring tool. During the coring process, the sealing ring 18 wraps the core, to prevent contamination of the fidelity-retaining cabin.

Figure 12:
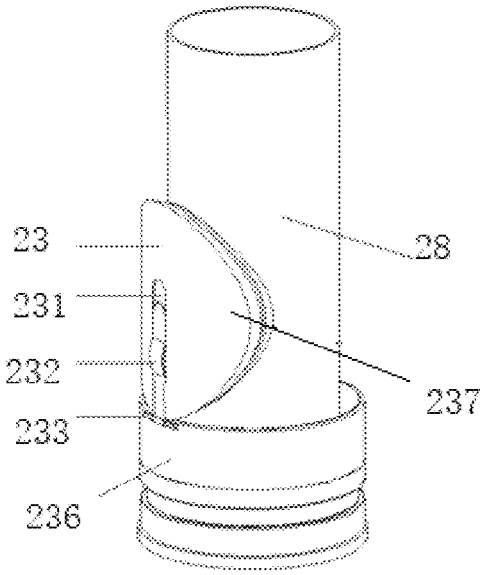
FIG. 12. The structural schematic diagram of the flap valve when it is not turned down.
Figure 13:
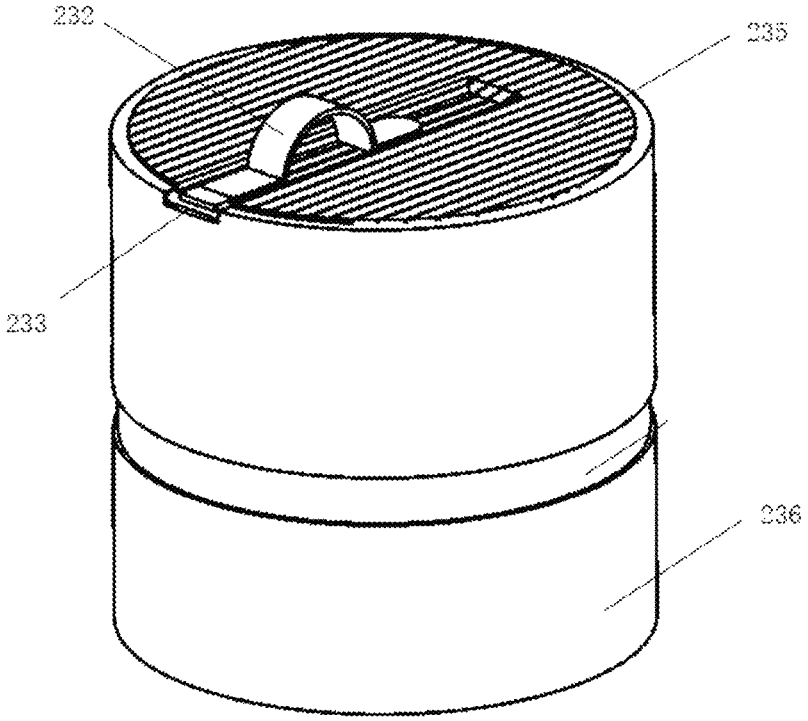
FIG. 13. The structural schematic diagram of the flap valve when it is turned down.
Figure 14:
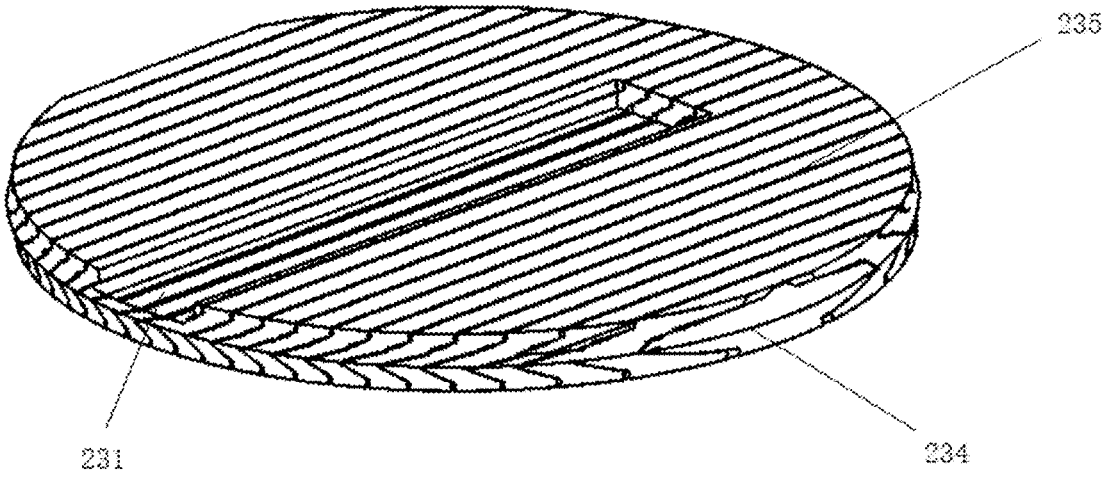
FIG. 14. The structural schematic diagram of the valve flap.

During operation, as the drilling of the drill bit 14, the rock core enters the inner core pipe 12 and passes through the middle of the core catcher 1. When the core passes through the hard jaw 112, the jaw 112 will be opened; when the drill is stopped and pulled upward, the jaw 112 will move upward with the inner core pipe 12. Because the free end of the jaw 112 retracts, at this time, it is difficult for the claw 112 to be stretched by the core. Because the core is unable to resist the great pulling force, and the free end of the jaw 112 are clamped inward, the core is broken at the site of jaw 112, and the broken core will continue to ascend with the jaw 112 so as to remain in the inner core pipe 12. As shown in FIGS. 12, 13 and 14, the flap valve 23 includes a valve seat 236 and a valve flap 237. The valve flap 237 includes an elastic sealing ring 234, elastic connecting strips 232, sealings, and a plurality of locking strips 235 arranged in parallel. The elastic connecting strip 232 connects all the locking strips in series, and the elastic sealing ring 234 loops all the locking strips 235 together, to form an integral structure. The locking strip 235 is provided with a groove 231 adapted to the elastic sealing ring, and the elastic sealing ring 234 is installed in the groove 231. There is a sealing between two adjacent locking strips 235. One end of the valve flap 23 is movably connected to the upper end of the valve seat 236 through a limit hinge 233; the valve flap 237 is curved when it is not turned down, and the valve flap 237 is attached to the outer wall of the inner coring barrel 28; the valve flap 237 is flat when it is turned down and covers the upper end of the valve seat 236.

Figure 15:
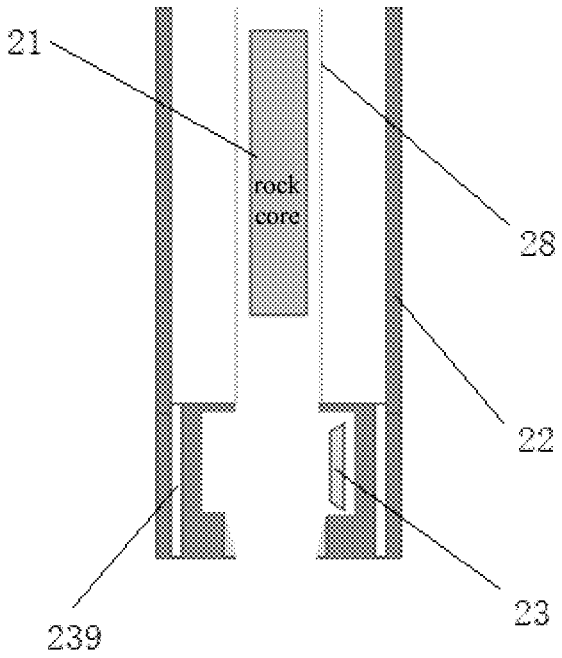
FIG. 15. The structural schematic diagram of the sealing cavity.

As shown in FIG. 15, the inner wall of the outer coring barrel 26 is provided with a sealing cavity 239, which is in communication with the inner coring barrel 28.

Figure 16:
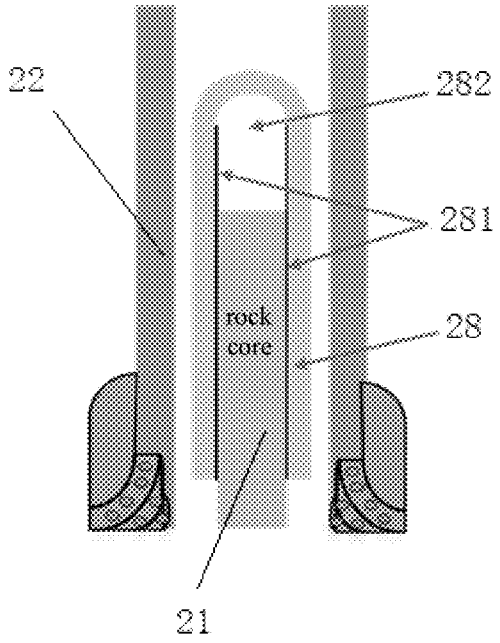
FIG. 16. A partial cross-sectional view of the inner core barrel.

As shown in FIG. 16, the inner coring barrel 28 is made of PVC material, and a graphene layer 281 is covered on the inner wall of the inner coring barrel 28. The upper part of the inner coring barrel 28 is filled with a drip film-forming agent 282.

Figure 17:
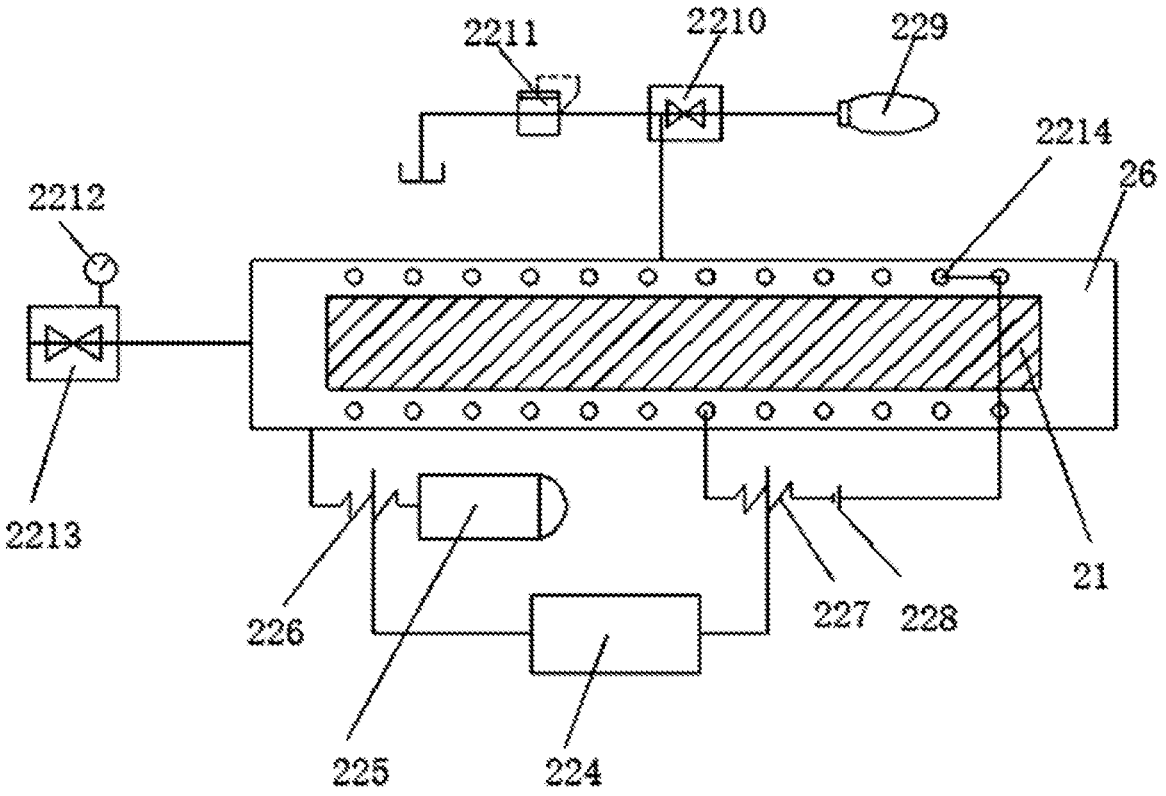
FIG. 17. The electrical schematic diagram of the present invention.

As shown in FIG. 17, the controlling unit comprises an electric heater 2214, a temperature sensor 25, and an electric control valve 226 arranged in the pipe. The temperature sensor 25 is connected to the processing unit 224. The electric heater 2214 is connected to the power supply 228 through a switch 227. The switch 227 and the electric control valve 226 are controlled by the processing unit 224. The electric heater is used to heat the inside of the outer coring barrel, and the temperature sensor is used to detect the temperature in the fidelity-retaining cabin. Electric heater 2214 is resistance wire, which is embedded in the inner wall of the outer coring barrel and coated with insulation layer. The power supply 228 of the control part is located on the outer coring barrel. The controlling unit also comprises a pressure sensor 27 and a three-way stop valve A 2210. The two ways of the three-way stop valve A 2210 are respectively connected with the energy accumulator 229 and the outer coring barrel 26, while the third way of the three-way stop valve A 2210 is connected with a pressure relief valve 2211. The stop valve A 2210 is an electrically controlled valve. The pressure sensor 27 and the three-way stop valve A 2210 are both connected to the processing unit 224. The pressure sensor 27 is used to detect the pressure in the fidelity-retaining cabin.

In the present invention, the device also includes a pressure gauge 2212, which is connected to the outer coring barrel by the three-way stop valve B 2213.

The temperature in the fidelity-retaining cabin is detected in real time by the temperature sensor, and compared with the in-situ temperature of the core previously measured. According to the difference between the two temperatures, the electric heater is controlled to heat or the electric control valve is controlled to open to inject liquid nitrogen into the fidelity-retaining cabin for cooling, so that the temperature in the constant fidelity-retaining cabin is the same as the in-situ temperature of the core. The pressure in the fidelity-retaining cabin is detected in real time by the pressure sensor, and compared with the in-situ pressure of the core previously measured. The on-off of the three-way stop valve A is controlled according to the difference between the two pressures, so that the pressure in the fidelity-retaining cabin is increased to keep the same as the in-situ pressure of the core. Since the ambient pressure of the fidelity-retaining cabin during the lifting process is gradually reduced, and the in-situ pressure of the core is greater than the ambient pressure of the fidelity-retaining cabin during the lifting process, thus pressurization measures can be used.

Figure 18:
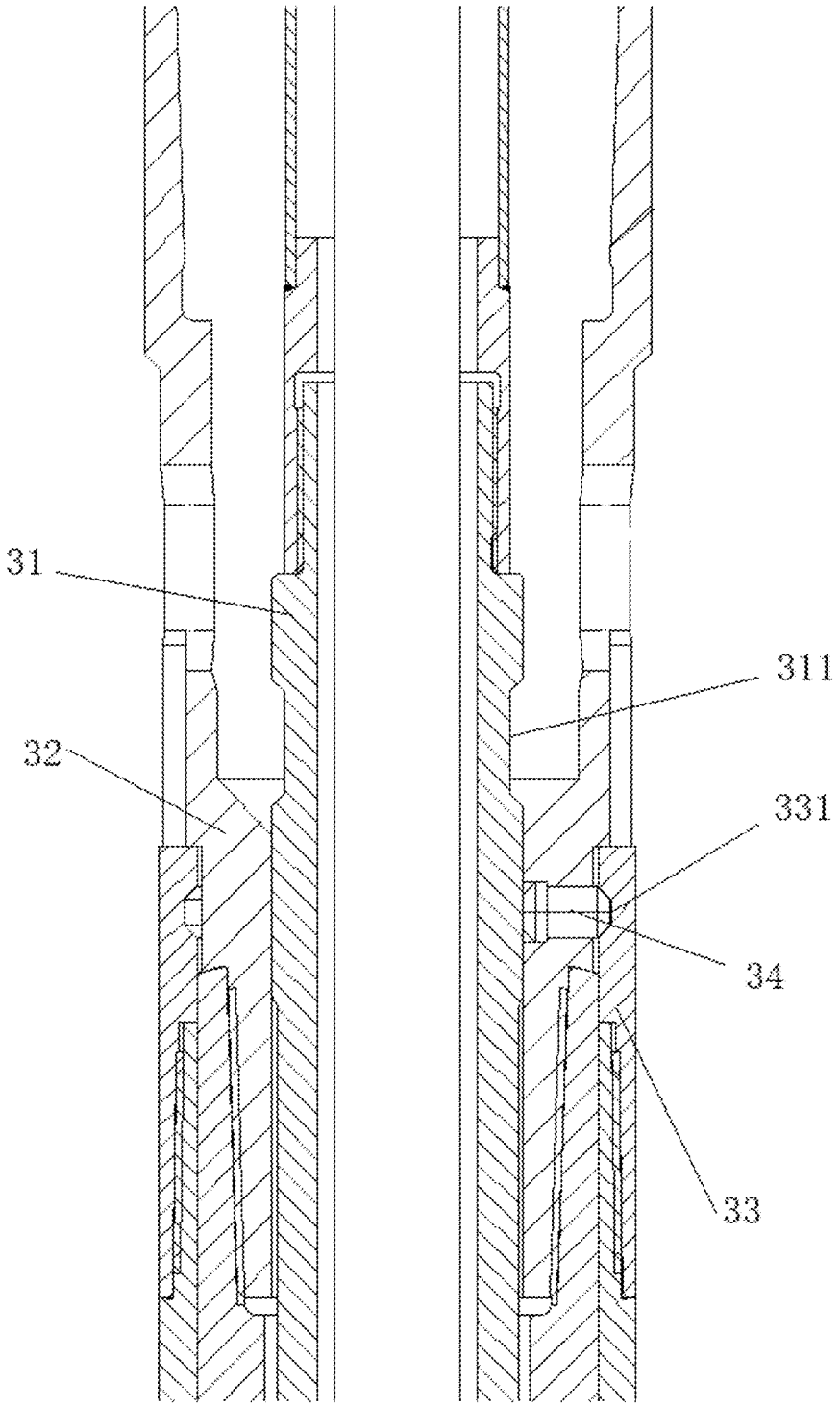
FIG. 18. The schematic diagram of the drill machine outer cylinder unlocking mechanism prior to starting.
Figure 19:
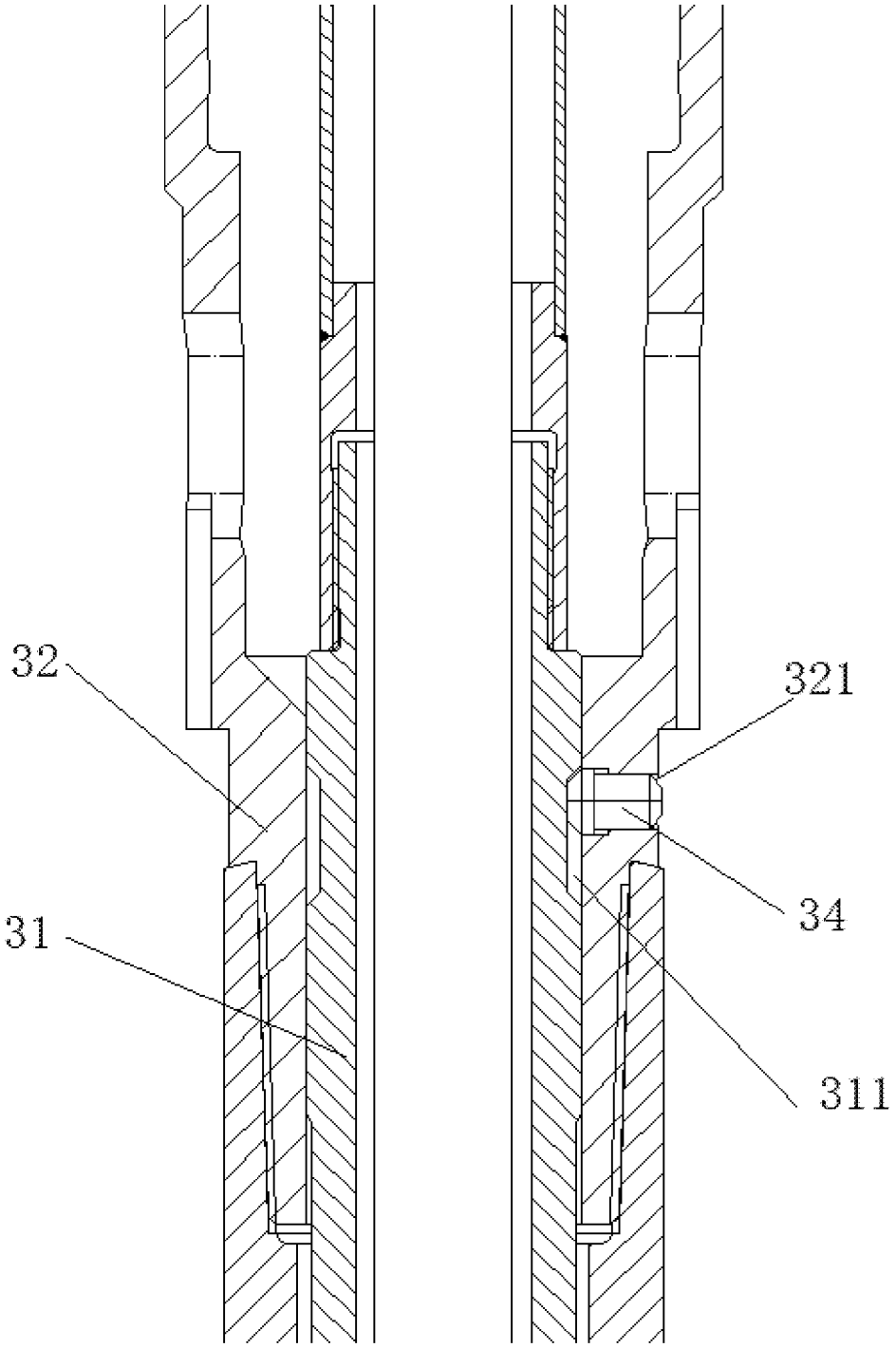
FIG. 19. The schematic diagram of the drill machine outer cylinder unlocking mechanism after starting.

As shown in FIGS. 18 and 19, the outer cylinder unlocking mechanism comprises a connecting pipe 32, an outer barrel 33 and a locking pin 31. The connecting pipe 32, the outer barrel 33 and the locking pin 31 are coaxial, the locking pin 31 is in the connecting pipe 32, and the outer diameter of the front section of the connecting pipe 32 is shorter than the inner diameter of the outer barrel 33. There is a through hole A 321 on the side wall of the front section of the connecting pipe, and the through hole A 321 is a round hole. There are three through holes A 321. The axial distance from the center of each through hole A 321 to the front end of the connecting tube 32 is the same, and three through holes A are evenly distributed along the circumference. There is a circular groove A311 on the outer wall of the locking pin 31, whose side surface is inclined. There is a groove B 331 on the inner wall of the outer barrel 33. The pin 34 is also comprised, whose length is greater than the depth of the through hole A 321. The number of pins 4 is the same as the number of through holes A 321, and the pin 4 is arranged in the through hole A 321. The outer end of the pin 34 is chamfered, and the side surface of the groove B 331 is inclined. The angle between the outer chamfer of the pin 34 and the radial section is complementary to the angle between the side of groove B 331 and the radial section. The pinv34 includes a nail head 341 and a nail body 342, and the pin head 341 is on the inside. A through hole A 321 is correspondingly provided with a nail head section 3211 and a nail body section 3212, and the pin head section is on the inside. The inner diameter of the pin head section 3211 is not less than the outer diameter of the pin head 341, while the inner diameter of the pin body section 3212 is not less than the outer diameter of the pin body 342. The length of the pin head 341 is less than the depth of the pin head section 3211, but the length of the pin body 342 is greater than the depth of the pin body section 3212. The width of groove A 311 is not less than the width of the inner end of the pin 34, while the width of the groove B 331 is not less than the width of the outer end of the pin 34. Before starting, the front end of the connecting pipe is in the outer barrel, and the pin is in front of the groove A. The inner end surface of the pin is in sliding fit with the outer wall of the locking pin, and the outer end of the pin is embedded in the groove B. A locking piece A is connected to the rear of the locking pin 31, and a locking piece B is connected to the rear of the connecting pipe 32. The outer diameter of the locking piece A is greater than the inner diameter of the locking piece B. The locking piece A is behind the locking piece B, and both of them cooperate with each other to limit the forward movement distance of the locking pin 31, so that it will not slide forward after reaching the working position. After starting, the inner end of the pin is embedded in the groove A. The distance from the inner end surface of the pin to the inner wall of the outer barrel is greater than the length of the pin. An interlocking mechanism is connected behind the connecting pipe 32, and a starting mechanism is connected behind the locking pin 31. A drill bit and a hydraulic motor rotor are connected in front of the outer barrel 33.

Figure 20:
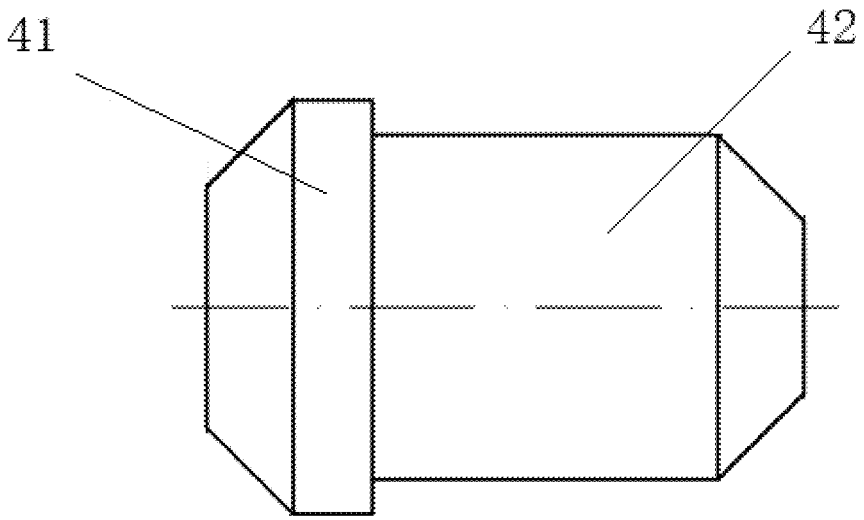
FIG. 20. The schematic diagram of the pin.

Before starting, the front end of the connecting pipe 32 is in the outer barrel 33, and the pin 34 is in front of the groove A 311. The inner end surface of the pin 34 is in sliding fit with the outer wall of the locking pin 31, and the outer end of the pin 34 is embedded in the groove B 31. After starting, the inner end of the pin 34 is embedded in the groove A 311. The distance from the inner end surface of the pin 34 to the inner wall of the outer barrel 33 is greater than the length of the pin 34. As shown in FIG. 20, the length of the pin 34 is 17.3 mm, wherein the length of the pin head 341 is 4.8 mm, and the length of the pin body 342 is 12.5 mm. The outer diameter of the pin head 341 is 12 mm, and the outer diameter of the pin body 342 is 10 mm. The inner and outer end faces of the pin 34 have a chamfer of 2.5 mm×45°.

Figure 21:
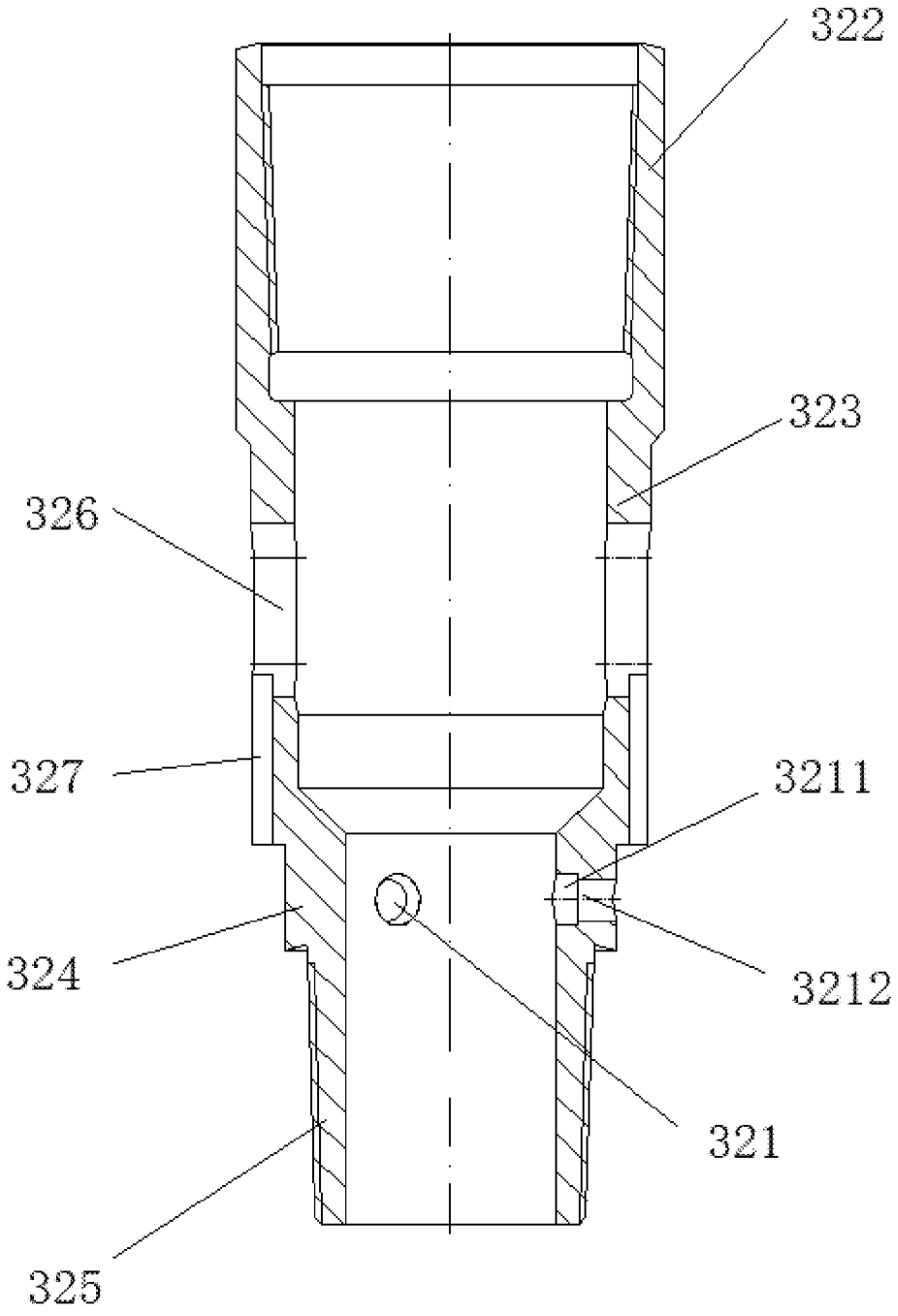
FIG. 21. The schematic diagram of the connecting pipe.

As shown in FIG. 21, the connecting pipe 32 includes a front section and a rear section. The rear section comprises the rear connecting section 322 and the liquid outlet section 323 from the back to the front. The front section of the connecting pipe comprises the nail-containing section 324 and the front connecting section 324 from the back to the front. The inner diameter of the rear connecting section 322 is greater than the inner diameter of the liquid outlet section 323, and the outer diameter of the rear connecting section 322 is also greater than the outer diameter of the liquid outlet section 323. The front end face of the rear connecting section 322 is inclined to the front from the outside to the inside, and the angle with the radial section is 45°. The rear connecting section 322 is provided with an internal thread, and there is a through hole B 326 in the liquid outlet section 323, which is a pressure relief hole. The outer diameter of the liquid outlet section 323 is 94.5 mm, and the inner diameter of the liquid outlet section 323 behind the through hole B 326 is 74 mm, while the inner diameter of the liquid outlet section 323 before the through hole B 326 is 72 mm. The front end face of the through hole B 326 and the inner wall of the liquid outlet section 323 are connected by an inclined plane having an angle of 76° with the radial section. The through hole B 326 is a strip hole, with a width of 16 mm. The front and rear sides of the through hole B 26 are semicircular arc surfaces, and the radius of the semicircular arc surface is 8 mm. The outer wall of the liquid outlet section 323 is provided with a diversion groove 327, and its width is 15 mm. The diversion groove 327 is in front of the through hole B 26. There are two through holes B 326 and two diversion grooves 327, which are evenly distributed along the circumference. The inner diameter of the front section of the connecting pipe is 50 mm. The inner wall of the liquid outlet section 323 and the inner wall of the section containing nails are connected by an inclined plane with an angle of 45° with the radial section. The connection position between the inner wall of the nail-containing section 324 and the inclined plane having an angle of 45° with the radial section is in the liquid outlet section 323. The through hole A321 is in the nail-containing section 24, and the thickness of the pipe wall of the nail-containing section 324 is 14 mm. The through hole A 321 is divided into a nail head section 3211 and a nail body section 3212. The depth of the nail head section 3211 is 5 mm, and the depth of the nail body section 3212 is 9 mm. The aperture of the nail head section 3211 is 12.1 mm, and the aperture of the nail body section 3212 is 10 mm. There are three through holes A 321, which are evenly distributed along the circumference. The outer diameter of the nail-containing section 324 is 78 mm, and the outer diameter of the front connecting section 325 is 67.9 mm. The front end surface of the nail-containing section 324 is inclined to the back from the outside to the inside, and the angle with the radial section is 15°. The length of the rear connecting section 322 is 155 mm, the length of the liquid outlet section 323 is 35 mm, the length of the nail-containing section 324 is 25 mm, the length of the front connecting section 325 is 65 mm, and there are external threads in the front connecting section 325.

Figure 22:
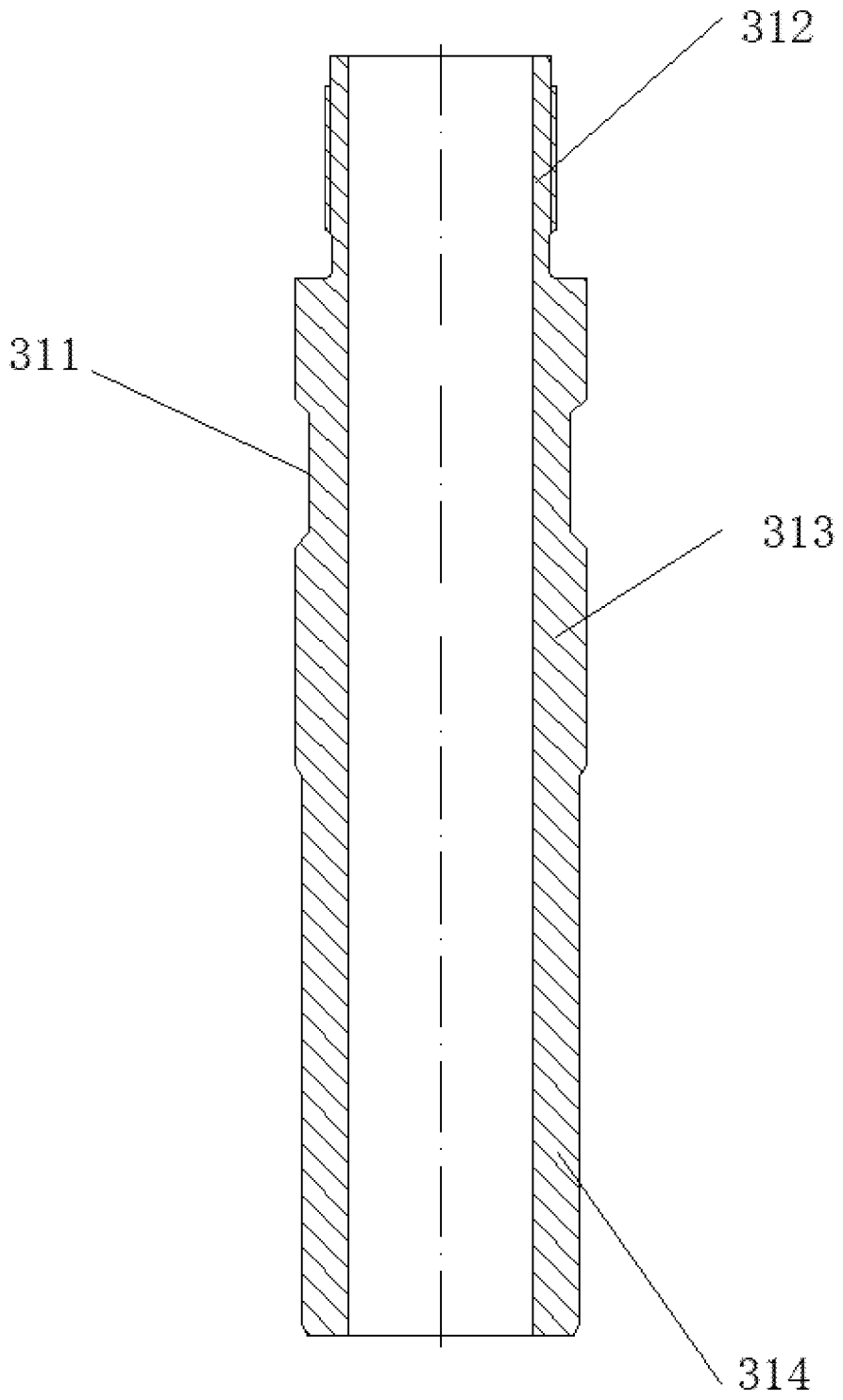
FIG. 22. The schematic diagram of the locking pin.

As shown in FIG. 22, the inner diameter of the locking pin 31 is 32 mm, and its length is 220 mm. The locking pin 31 sequentially comprises the connecting part 312, the working part 313 and the insertion part 314 from back to front. The length of the connecting part 312 is 38 mm, and its outer diameter is 38 mm. There are M40×1.5 threads in the outer wall of the connecting part 312. But, no thread is provided in the area of the outer wall of the connecting part 312 which is not more than 8 mm away from the front end face of the working part. The length of the working part 313 is 63 mm, and the outer diameter is 50 mm. The groove A 311 is located on the outer wall of the working part 313. The distance from the bottom surface of the groove A 311 to the axis of the locking pin 1 is 22.5 mm. The distance from the front end of the connecting part 312 to the front end of the opening of the groove A 311 is 59 mm. The opening width of the groove A 311 is 25.5 mm, and the bottom surface of the groove A 311 and the outer wall of the working part 313 are connected by an inclined plane having an angle of 45° with the radial section. The length of the insertion part 314 is 98 mm, and the outer diameter is 48 mm.

Before the drilling machine is started, the pin 34 is inserted into the groove B 331 to fix the outer barrel 33. When the drilling machine is started, the locking pin 31 slides forward, and the inner end of the pin 34 is in a sliding fit with the outer wall of the locking pin 31. When the groove A 311 slides forward to the same axial position as the pin 34, the outer barrel 33 generates forward pressure by its own gravity. The contact surface between the groove B 331 and the pin 34 is an inclined surface. The groove B 331 presses the inclined surface of the pin 34, and the pin 34 is withdrawn from the groove B 331 and is pressed into the groove A 311 to release the constraint on the outer barrel 33.

Certainly, there still may be various other examples of the present invention. Without department from the spirit and the essence of the present invention, those skilled in the art can make various corresponding changes and modifications according to the present invention, which should be within the scope of the claims of the present invention.

The invention claimed is:

1. An in-situ condition-retaining coring system, comprising: a driving module, a retaining module, and a coring module that are sequentially connected, wherein the coring module comprises a rock core drilling tool and a rock core sample storage cylinder, wherein the retaining module comprises a rock core sample retaining compartment, the driving module comprises a coring drill machine having a drill machine outer cylinder unlocking mechanism, wherein the rock core drilling tool comprises a coring drill tool, a core catcher, and an inner core pipe, the coring drill tool comprising an outer core pipe and a hollow drill bit connected to a lower end of the outer core pipe, the core catcher comprising an annular base and a plurality of claws, the annular base being coaxially mounted on an inner wall of a lower end of the inner core pipe, and the plurality of claws are evenly arranged on the annular base, wherein a lower end of each claw is connected with the annular base, and an upper end of each claw is closed inward, the lower end of the inner core pipe extends to a bottom of the outer core pipe, and the inner core pipe is in clearance fit with the outer core pipe, wherein the core sample storage barrel comprises a rock core barrel, a drilling machine outer cylinder, a flap valve, and a trigger mechanism, the flap valve comprising a valve seat and a sealing flap, the valve seat being coaxially mounted on an inner wall of the drilling machine outer cylinder, and one end of the sealing flap being movably connected to an outer sidewall of the upper end of the valve seat, a top of the valve seat being provided with a valve port sealing surface matching the sealing flap, wherein the rock core sample fidelity-retaining compartment comprises an inner coring barrel, an outer coring barrel, and an energy accumulator, the outer coring barrel being sleeved on the inner coring barrel, an upper end of the inner coring barrel in communication with a liquid nitrogen storage tank located in the outer coring barrel, the energy accumulator in communication with the outer coring barrel having a flap valve, wherein the outer cylinder unlocking mechanism comprises a connecting pipe, an outer barrel, and a locking pin that are coaxially arranged, the locking pin disposed in the connecting pipe, and an outer diameter of a front section of the connecting pipe is shorter than an inner diameter of the outer barrel, and a through hole is arranged on a side wall of the front section of the connecting pipe, a first groove is arranged on an outer wall of the locking pin, while a second groove is arranged on an inner wall of the outer barrel, a pin having a length greater than a depth of the through hole extends through the through hole, and an outer end of the pin is chamfered and/or a side surface of the second groove is inclined, wherein a width of the first groove is not less than a width of the inner end of the pin, while a width of the second groove is not less than a width of the outer end of the pin, wherein, when the in-situ condition-retaining coring system is not started, a front end of the connecting pipe is in the outer barrel, and the pin is in front of the first groove, the inner end surface of the pin is in a sliding fit with an outer wall of the locking pin, and the outer end of the pin is embedded in the second groove, and, when the in-situ condition-retaining coring system is started, the inner end of the pin is embedded in the first groove, and a distance from the inner end surface of the pin to the inner wall of the outer barrel is greater than the length of the pin.

2. The in-situ condition-retaining coring system according to claim 1, wherein the rock core sample retaining compartment further comprises an electric heater, a temperature sensor, an electric control valve arranged between the inner coring barrel and the liquid nitrogen storage tank, a pressure sensor, and a three-way stop valve arranged between the energy accumulator and the outer coring barrel, wherein a first way and the second way of the three-way stop valve are respectively connected with the energy accumulator and the outer coring barrel, while a third way of the three-way stop valve is connected with a pressure relief valve, and wherein the electric heater is configured to heat the outer coring barrel, the temperature sensor is configured to detect a temperature in the fidelity-retaining compartment, and the pressure sensor is configured to detect a pressure in the fidelity-retaining compartment.

3. The in-situ condition-retaining coring system according to claim 2, wherein the electric heater is a resistance wire embedded in the inner wall of the outer coring barrel, a graphene layer is coated on the inner wall of the inner coring barrel, and an upper part of the inner coring barrel is filled with a drip film-forming agent.

4. The in-situ condition-retaining coring system according to claim 1, wherein the drill bit comprises an inner drill bit and an outer drill bit, the inner drill bit being installed in the outer drill bit, and wherein three first-stage blades are arranged at equal intervals in a circumferential direction on a lower end of the inner drill bit, and three second-stage blades are arranged at equal intervals in a circumferential direction on an outer sidewall of the outer drill bit, and both the three first-stage blades and the three second-stage blades are provided with coolant circuit holes.

5. The in-situ condition-retaining coring system according to claim 1, wherein the outer core pipe and the outer wall of the drill bit are both provided with a spiral groove, and the spiral groove on the drill bit is continuous with the spiral groove on an outer core tube.

6. The in-situ condition-retaining coring system to claim 1, wherein each of the plurality of claws comprises a vertical arm and a tilt arm which are integrally manufactured, a lower end of the vertical arm is connected with the annular base, an upper end of the vertical arm is connected with a lower end of the tilt arm, the upper end of the tilt arm is a free end, and the tilt arm is configured to tilt inward from bottom to top.

7. The in-situ condition-retaining coring system of a rock according to claim 1, wherein the sealing valve flap includes an elastic sealing ring, an elastic connecting strips, a plurality of sealings, and a plurality of locking strips arranged in parallel, wherein the elastic connecting strip connects the plurality of locking strips in series, and the elastic sealing ring loops the plurality of locking strips together to form an integral structure, each locking strip is provided with a groove adapted to receive the elastic sealing ring, two adjacent locking strips have one of the plurality of sealings arranged therebetween, one end of the valve flap is movably connected to the upper end of the valve seat through a limit hinge, and the valve flap is attached to the outer wall of the inner coring barrel.

8. The in-situ condition-retaining coring system according to claim 1, wherein the inner wall of the outer coring barrel is provided with a sealing cavity, and a flap plate is located in the sealing cavity, and the sealing cavity is in communication with the inner coring barrel.

9. The in-situ condition-retaining coring system according to claim 1, wherein an interlocking mechanism is connected with the connecting pipe, and a starting mechanism is connected with the locking pin, a side surface of the first groove is an inclined plane, the drill bit and a hydraulic motor rotor are connected in front of the outer barrel, a first locking piece is connected with the locking pin, and a second locking piece is connected with the connecting pipe, an outer diameter of the first locking piece is greater than an inner diameter of the second locking piece, and the first locking piece is behind the second locking piece, an angle between an outer chamfer of the pin and a radial section is complementary to an angle between a side of second groove and the radial section, the pin has a nail head and a nail body, and a through hole is correspondingly provided with a nail head section and a nail body section.

10. The in-situ condition-retaining coring system according to claim 9, wherein a length of the pin head is less than a depth of a pin head section, a length of the pin body is greater than a depth of a pin body section.

* * * * *